United States Patent [19]

Ohno

[11] 4,364,480

[45] Dec. 21, 1982

[54] GLASS STAND

[75] Inventor: Mutsuyuki Ohno, Nagoya, Japan

[73] Assignee: Cho-Jirushi Plastics Industry Co., Ltd., Aichi, Japan

[21] Appl. No.: 137,155

[22] Filed: Apr. 4, 1980

[30] Foreign Application Priority Data

Apr. 10, 1979 [JP] Japan ..... 54-47360[U]

[51] Int. Cl.[3] ..... A47G 29/00

[52] U.S. Cl. ..... 211/85; 211/105; 211/202

[58] Field of Search ..... 211/71, 11, 74, 85, 211/105, 202, 96, 168

[56] References Cited

U.S. PATENT DOCUMENTS 245,897 8/1881 Watters ..... 211/105

FOREIGN PATENT DOCUMENTS 710752 8/1931 France ..... 211/96

*Primary Examiner*—William H. Schultz
*Assistant Examiner*—Ramon O. Ramirez
*Attorney, Agent, or Firm*—Martin A. Farber

[57] ABSTRACT

Disclosed herein is a glass stand for supporting a plurality of glasses with bottoms upward. The glass stand comprises a plurality of connecting members which are pivotably overlappingly connected with one another to form a pantagraph-shaped body. The pantagraph-shaped body are provided with a plurality of vertical bars for supporting the glasses.

2 Claims, 12 Drawing Figures

GLASS STAND

BACKGROUND OF THE INVENTION

1. Field of the Invention

The present invention relates to a glass stand to be placed on a table.

2. Description of the Prior Art

A conventional glass stand is adapted to support the inner bottom surfaces of a plurality of glasses with bottoms upward by supporting members. Such a prior art includes the type comprising a plurality of radially provided lateral bars each provided with a vertical supporting member in its forward end and the type comprising a base plate provided with a plurality of vertical supporting members. However, such types of glass stands take up much room when not in use and put in cupboards.

SUMMARY OF THE INVENTION

The object of the present invention is to provide a glass stand which can be contracted in width to save space therefor when not in use and to be put in a cupboard or to be packed up.

According to the present invention, there is provided a glass stand comprising a plurality of connecting members forming a pantagraph which can easily be contracted in width to save the space therefor in a cupboard when not in use. Since the size of the glass stand according to the present invention can be reduced by contraction, it can be easily packed up to save freight charges in case of transportation. Further, the glass stand according to the present invention is effective in supporting six or more glasses.

DESCRIPTION OF THE PREFERRED EMBODIMENT

Figure 1:
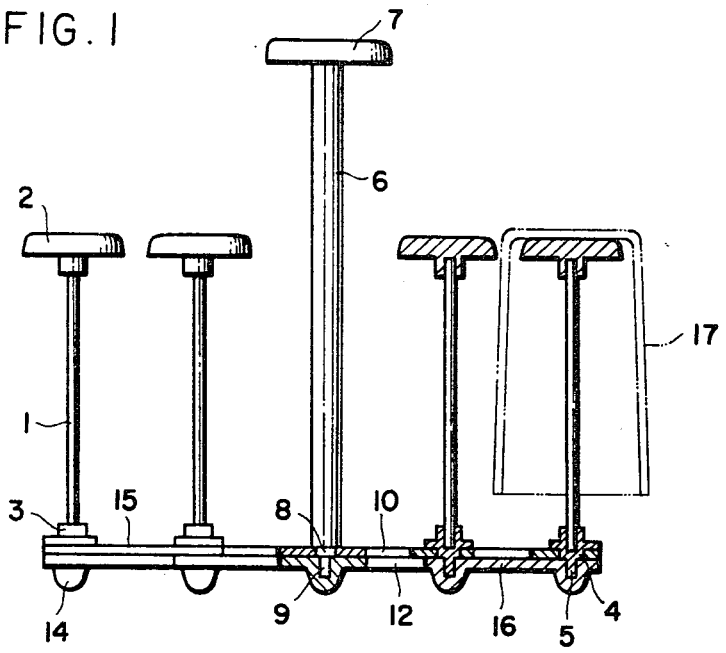
FIG. 1 is a partially fragmentary front elevational view of the glass stand according to the present invention.

Referring now to FIG. 1 of the drawings in which a glass stand according to the present invention is shown, numeral 1 indicates a plurality of rods each provided in its upper end with an annular plate 2 for supporting a glass 17 with bottom upward. The lower end of each of the rods 1 is engaged in a holder 3 from which a large-diametrical shaft 4 and a coaxial small-diametrical shaft 5 extend steppedly downwardly. Numeral 6 indicates a handle bar which is provided with a grip 7 in its upper end and a large-diametrical shaft 8 and a coaxial small-diametrical shaft 9 extending steppedly downwardly from its lower end.

In the embodiment of the present invention as shown in the drawings, the large-diametrical shaft 8 and the small-diametrical shaft 9 of the handle bar 6 are identical in size and shape with the large-diametrical shafts 4 and the small-diametrical shafts 5 of the holders 3 respectively, though, they may not necessarily be identical.

Figure 3:
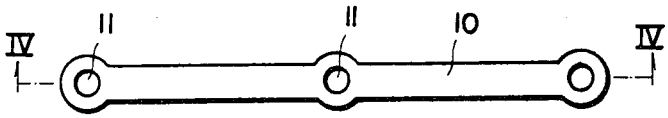
FIG. 3 is a top plan view showing an upper connecting member.
Figure 4:
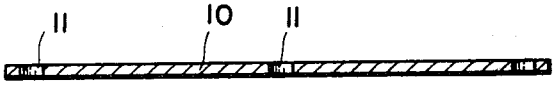
FIG. 4 is a cross sectional view taken along the line IV—IV in FIG. 3.

Numeral 10 indicates a long connecting member which is provided with three holes 11 in its center and both ends for receiving the large-diametrical shafts 4 and 8 of the holders 3 and the handle bar 6 (see FIG. 3).

Figure 5:
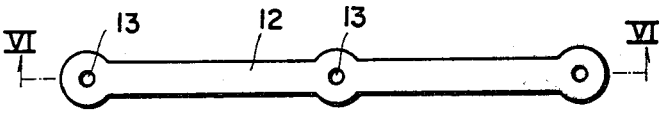
FIG. 5 is a top plan view of a lower connecting member.
Figure 6:
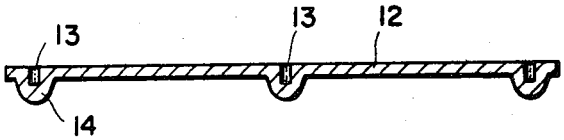
FIG. 6 is a cross sectional view taken along the line VI—VI in FIG. 5.

Under the connecting member 10, there is located another long connecting member 12 which is equal in length with the connecting member 10 and provided with three holes 13 formed in positions corresponding to those of the holes 11 of the connecting member 10 for receiving the small-diametrical shafts 5 and 9 of the holders 3 and the handle bar 6 (see FIG. 5). A plurality of legs 14 extend downwardly from the lower surface of the lower connecting member 12 just under the holes 13 as shown in FIG. 6. The upper connecting member 10 is placed on the lower connecting member 12 so that the large-diametrical shaft 8 of the handle bar 6 is engaged in the central hole 11 of the upper connecting member 10 and the small-diametrical shaft 9 is engaged in the central hole 13 of the lower connecting member 12 and secured thereto by a means such as a bonding agent, thereby making the upper connecting member 10 pivotally rotatable.

Figure 7:
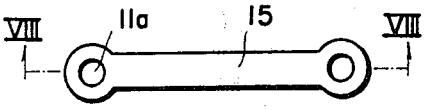
FIG. 7 is a top plan view of an upper small connecting member.
Figure 9:
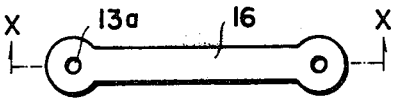
FIG. 9 is a top plan view of a lower small connecting member.
Figure 8:
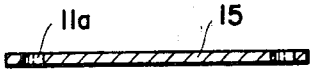
FIG. 8 is a cross sectional view taken along the line VIII—VIII in FIG. 7.
Figure 10:
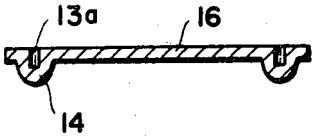
FIG. 10 is a cross sectional view taken along the line X—X in FIG. 9.
Figure 11:
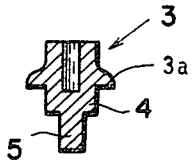
FIG. 11 is a cross sectional view of a holder.

There are further provided a pair of short connecting members 15 which are substantially half the length of the upper connecting member 10, and each of the short connecting members 15 has in both ends a pair of holes **11*a* for receiving the large-diametrical shafts 4 of the holders 3 (see FIG. 7). One of the ends of the short connecting members 15 respectively is placed on one end of the lower connecting member 12 respectively. Under the connecting members 10 and 15, there are provided another pair of short connecting members 16 which are substantially half the length of the lower connecting member 12, and each of the short connecting members 16 has in both ends a pair of holes 13*a* for receiving the small-diametrical shafts 5 of the holders 3 and a pair of legs 14 extending downwardly from just under the holes 13*a* as shown in FIGS. 9 and 10**.

The large-diametrical shafts 4 and the small-diametrical shafts 5 of the holders 3 are engaged in the holes **11*a* of the short connecting members 15 and in the holes 13 of the lower connecting member 12 respectively. One of the ends of the lower short connecting members 16 are placed under both ends of the upper connecting member 10 while the other ends thereof are placed under the other ends of the upper short connecting members 15 so that the large-diametrical shafts 4 of the holders 3 are engaged in the holes 11 of the upper connecting member 10 and the holes 11*a* of the short connecting members 15 and the small-diametrical shafts 5 of the holders 3 are engaged in the holes 13*a* of the lower short connecting members 16 respectively. The holders (pivot means) 3 include a flange 3*a* having a diameter larger than that of said larger diameter shaft portion 4** engaging an upper side of the upper members.

Namely, the connecting members 10, 12, 15 and 16 are pivotably connected with one another to form a continuous pantagraph-shaped body 18, and the rods 1 for supporting the glasses 17 are vertically inserted in the connected portions respectively. The connecting members are preferably connected with one another so that thev are pivotally moved upon receipt of relatively strong force.

Figure 2:
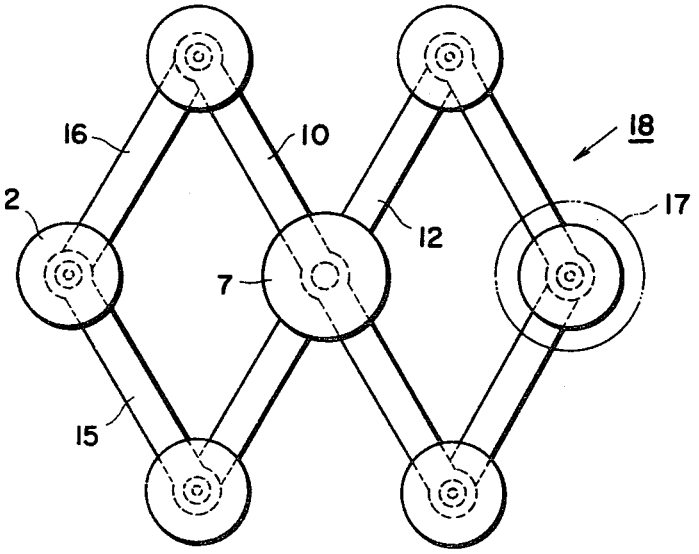
FIG. 2 is a top plan view of the glass stand of FIG. 1.
Figure 12:
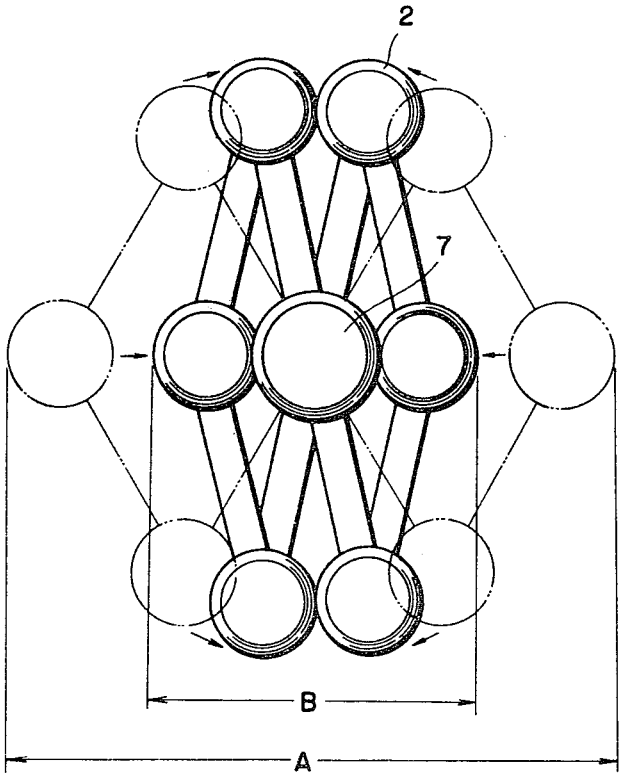
FIG. 12 is an illustrative view showing the change in size of the glass stand upon expansion and contraction thereof.

When in use, the glass stand according to the present invention is expanded as shown in FIGS. 1 and 2. When the glass stand is not in use and to be put in a cupboard, the glasses 17 are removed and the glass stand is contracted by appliance of force from both sides toward the center thereof as shown in FIG. 12 so that the annular plates 2 in line contact with each other. Namely, the glass stand is contracted from an expanded state as shown in phantom lines to a state as shown in solid lines in FIG. 12. In this condition, the glass stand shows substantially no change in length, but the width thereof is changed from that indicated by A to that indicated by B in FIG. 12. Namely, the glass stand becomes considerably small in width to save the space therefor.

In the aforementioned embodiment, the glass stand is adapted to support six glasses 17 by six rods, though, the connecting members may be increased in number and/or in length to increase the number of the rods 1 for supporting more glasses.

Further, the connecting members may be provided with appropriate projections so that the projections contact with the side surfaces of adjacent connecting members when the glass stand is expanded to limit expansion thereof.

While the invention has been described with reference to a preferred embodiment thereof, it is to be understood that modifications or variations may be easily made without departing from the scope of this invention which is defined by the appended claims.

What is claimed is:

1. A glass stand for supporting a plurality of glasses with bottoms upward, said stand comprising, a plurality of upper members, a plurality of lower members, a plurality of pivot means, said members being arranged in the form of a pantagraph and having apertures located at cross points of said pantagraph for receiving said pivot means, said members being pivoted about said plurality of pivot means for expansion and contraction of said pantagraph, each of said lower members having legs extending therefrom at respective sites of the apertures in said lower members and being mounted to respective ones of said pivot means received by said apertures, said pivot means extending from said lower members in a direction opposite from said legs, said pivot means passing through the apertures of said upper members for pivotal connection therewith, means extending upwardly from individual ones of said pivot means for engagement with said glasses, wherein the pivot means has a larger diameter shaft portion complementarily disposed in a corresponding of said apertures of said upper members and a smaller diameter shaft portion coaxial to said larger diameter shaft portion complementarily disposed in a corresponding of said apertures of said lower members.

2. The glass stand according to claim 1, wherein said pivot means includes a flange having a diameter larger than that of said larger diameter shaft portion engaging an upper side of said upper members.

* * * * *